US005851347A

United States Patent [19]

Rodriguez

[11] Patent Number: 5,851,347

[45] Date of Patent: Dec. 22, 1998

[54] STAMP AFFIXER APPARATUS AND METHOD

[75] Inventor: Humberto Rodriguez, Wabash, Ind.

[73] Assignee: Martin Yale Industries, Inc., Wabash, Ind.

[21] Appl. No.: 825,895

[22] Filed: Apr. 2, 1997

[51] Int. Cl.[6] ..... B44C 1/10

[52] U.S. Cl. ..... 156/576; 156/577; 156/DIG. 33; 225/41; 225/54

[58] Field of Search ..... 156/574, 576, 156/577, 579, DIG. 33; 225/39, 41, 46, 54, 56; 221/71, 73

[56] References Cited

U.S. PATENT DOCUMENTS

| | | | |
|---|---|---|---|
| D. 273,202 | 3/1984 | Oglander et al. . | |
| 921,059 | 5/1909 | Baeyertz | 156/576 X |
| 1,896,343 | 2/1933 | Bennett | 225/54 |
| 2,602,719 | 7/1952 | Thiene et al. . | |
| 3,186,589 | 6/1965 | West et al. . | |
| 3,537,933 | 11/1970 | Severance . | |
| 3,698,600 | 10/1972 | Foote | 221/73 X |
| 3,941,278 | 3/1976 | Oglander et al. . | |
| 3,955,711 | 5/1976 | Schröter et al. | 156/577 X |
| 3,969,181 | 7/1976 | Seabold | 156/577 |
| 4,194,646 | 3/1980 | Oglander et al. . | |
| 4,214,938 | 7/1980 | Figg . | |
| 4,496,049 | 1/1985 | Pabodie et al. . | |
| 4,525,237 | 6/1985 | Clar | 156/577 X |
| 4,576,311 | 3/1986 | Horton et al. | 156/DIG. 48 X |
| 4,585,144 | 4/1986 | Granzow et al. . | |
| 4,780,172 | 10/1988 | Shea | 156/579 X |
| 4,813,571 | 3/1989 | Slagter . | |
| 4,826,558 | 5/1989 | Wada et al. . | |
| 4,891,090 | 1/1990 | Lorincz et al. | 156/579 X |
| 4,925,073 | 5/1990 | Tarrson et al. | 225/46 X |
| 5,005,730 | 4/1991 | Pickrell, Jr. et al. | 221/71 |
| 5,065,896 | 11/1991 | Jurgich . | |
| 5,071,030 | 12/1991 | Marcusen . | |
| 5,178,717 | 1/1993 | Rodriguez | 156/577 X |
| 5,449,090 | 9/1995 | Rodriquez . | |
| 5,685,944 | 11/1997 | Nose et al. | 156/577 X |

FOREIGN PATENT DOCUMENTS

| | | | |
|---|---|---|---|
| 5-330531 | 12/1993 | Japan | 156/DIG. 33 |

*Primary Examiner*—Mark A. Osele
*Attorney, Agent, or Firm*—Brinks Hofer Gilson & Lione

[57] ABSTRACT

A stamp affixer apparatus and method is disclosed. A top shell, bottom shell attached to the top shell, and a stamp housing is provided. A first gear assembly is rotatably attached to the stamp housing. A second gear assembly is engaged with the first gear assembly and rotatably attached to the stamp housing. A drive roller is fixedly attached to the second gear assembly. A roll of adhesive backed stamps on backing paper may be inserted in a portion of the stamp housing. A lead-in portion of the backing paper is attached to a shaft portion of the first gear assembly. As the drive roller is pulled along a desired surface, its rotation is translated through the second gear assembly to the first gear assembly. The first gear assembly winds up the backing paper and an adhesive backed stamp is dispensed against the surface.

18 Claims, 6 Drawing Sheets

FIG. 4
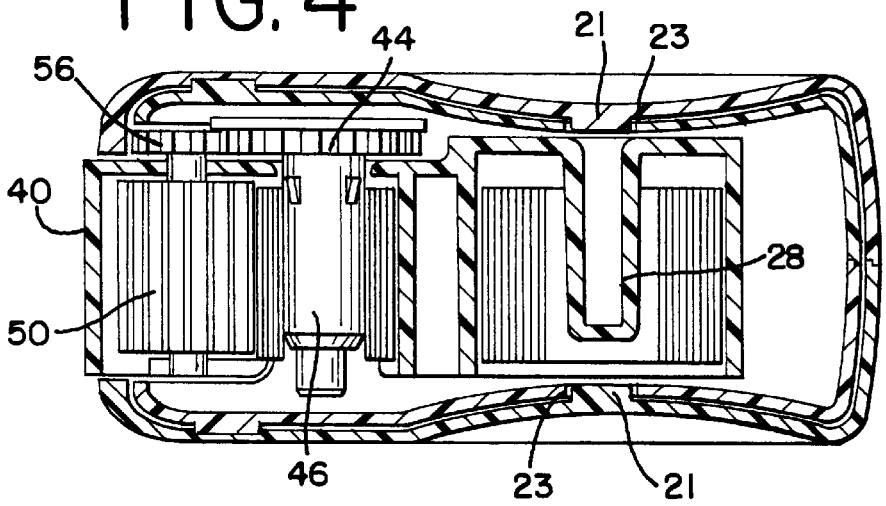
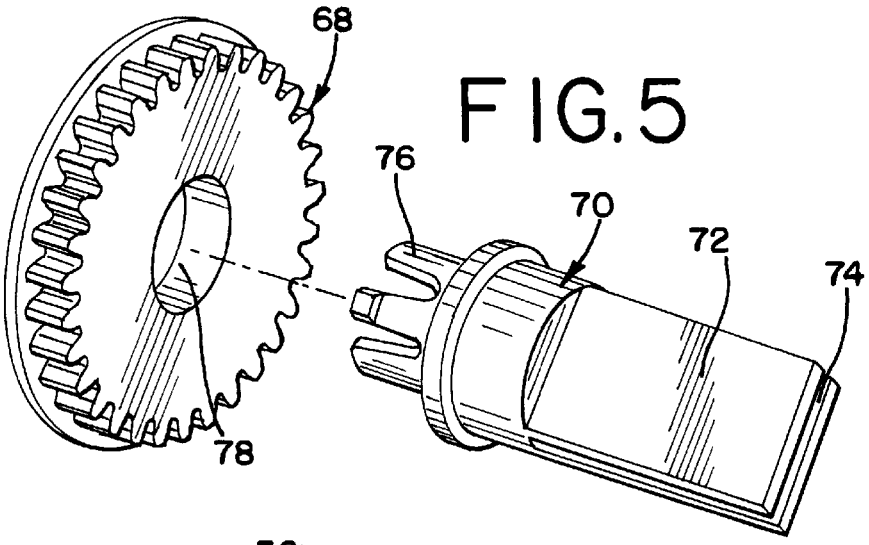
FIG. 5
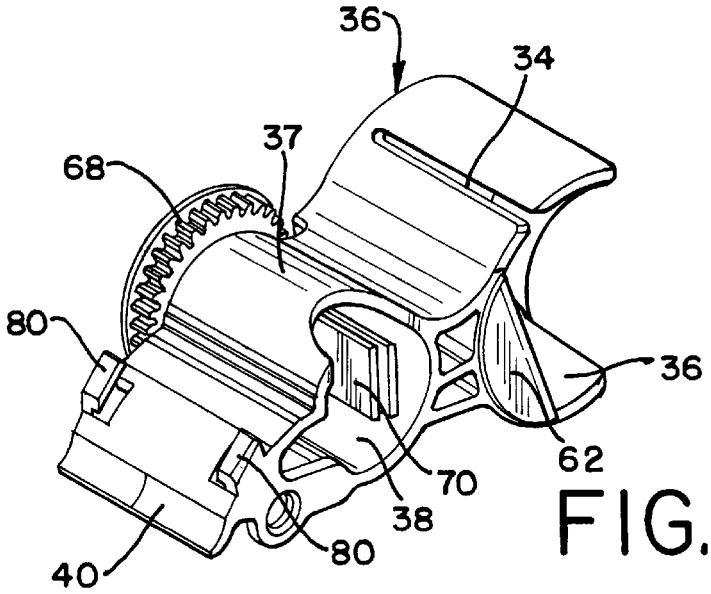
FIG. 6

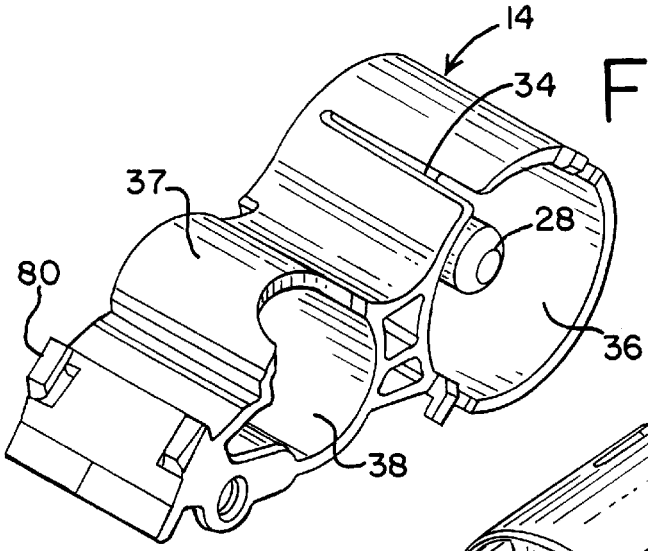
FIG. 17
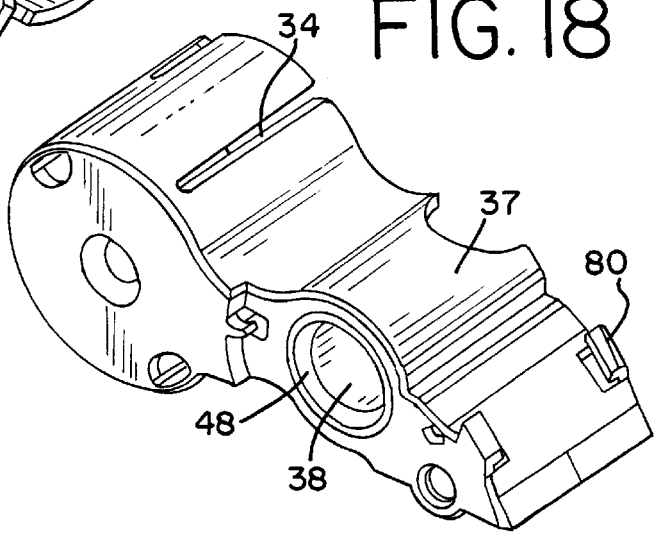
FIG. 18
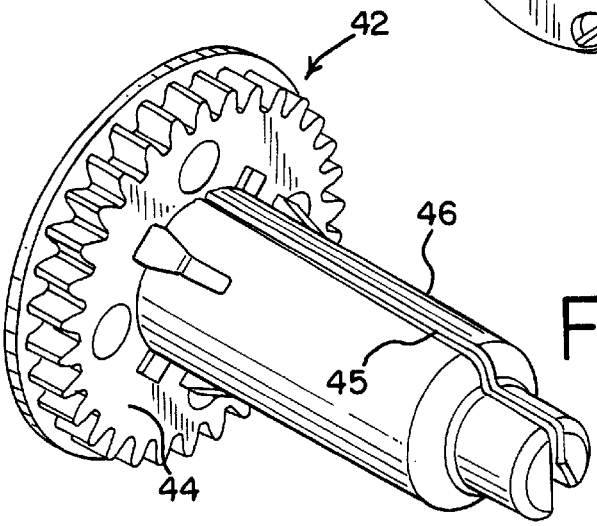
FIG. 19
FIG. 20
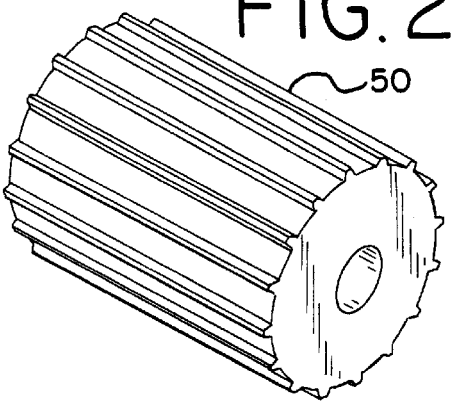
FIG. 21
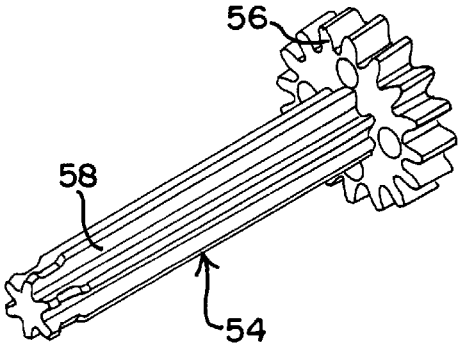

STAMP AFFIXER APPARATUS AND METHOD

FIELD OF THE INVENTION

This invention relates generally to a stamp affixer apparatus and method for dispensing and affixing stamps. More specifically, the invention relates to a postage stamp affixer for dispensing and applying adhesive-backed postage stamps on envelopes and packages.

BACKGROUND OF THE INVENTION

In general stamp and label dispensers have been used to provide the user with easy access to the stamp or label. In general, both mechanical and electric label dispensers are designed to roll up the backing paper and expose the adhesive backed label. The label may then be removed easily by the user and hand applied to the envelope. Many of these label dispensers, for example, as disclosed in U.S. Pat. No. 5,449,090, require the user to manually remove the stamp or label and apply it to the desired surface. These devices may also require a nearby electric outlet, and/or may be larger and more cumbersome than necessary to perform the simple function of dispensing, for example, a postage stamp.

With the recent replacement of the old-style postage stamps by the U.S. Postal Service, with rolls of adhesive backed postage stamps with backing paper, there is an immediate need for an inexpensive personal and portable stamp affixer. It would be desirable to provide a low cost personal stamp affixer that would both dispense and apply the adhesive backed stamp to the envelope or package. It would also be desirable to manufacture a stamp affixer made of an easy to assemble modular design.

SUMMARY OF THE INVENTION

One aspect of the invention provides a stamp affixing apparatus including a stamp housing, a first gear assembly, a second gear assembly, and a drive roller. The first gear assembly is rotatably attached to the stamp housing and engaged with a second gear assembly. The second gear assembly is fixedly attached to a drive roller and rotatably attached to the stamp housing. An outer shell may preferably partially enclose the stamp housing. The outer shell preferably includes a top shell rotatably attached to the bottom shell. A window may be preferably positioned between two sections of the top shell to allow a user to visually inspect the stamps. A raised portion formed on an outer surface of the bottom shell portion to engage with a recessed area formed on an inner surface of the top shell portion. Preferably, the outer surface of the stamp housing is curved to aid in the breaking of perforations between the stamps. The stamp housing preferably includes a separating edge in which backing paper is pulled over and separated from adhesive backed stamps. Preferably, the stamp housing is made of molded plastic.

Another aspect of the invention provides a method of affixing adhesive backed stamps. A stamp housing including a first gear assembly engaged with a second gear assembly, and a drive roller are provided. The first gear assembly is rotatably attached to the stamp housing, and the second gear assembly fixedly attached to a drive roller and rotatably attached to the stamp housing. A roll of adhesive backed stamps on backing paper is positioned in the stamp housing, and a lead-in portion of the backing paper attached to the first gear assembly. The drive roller is pulled along a desired surface to rotate the drive roller and the second gear assembly in a clockwise direction. This action, simultaneously rotates the first gear assembly in a counter-clockwise direction to wrap the backing paper around the first gear assembly and dispense the stamp against the surface.

Another aspect of the invention provides a stamp affixing apparatus including a top shell, a bottom shell rotatably attached to the top shell, and a stamp housing positioned partially within an enclosure formed between the top shell and bottom shell. The stamp housing includes a stamp roll housing portion and a backing paper housing portion. A first gear assembly is rotatably attached to the backing paper housing portion. The second gear assembly is engaged with the first gear assembly and rotatably attached to the stamp housing. A drive roller is fixedly attached to the second gear assembly. The outer surface of the stamp housing preferably includes a curved contour to aid in breaking the perforations between the stamps. The first gear assembly may preferably include a gear wheel attached to a shaft having a slit formed therein for receiving a lead-in portion of backing paper. A spindle formed in the stamp roll housing may alternatively be provided to receive a stamp roll. The second gear assembly may include a gear wheel attached to a shaft, and the gear wheel of the second gear assembly may be smaller than the gear wheel of the first gear assembly to translate the desired rotation to dispense the desired stamp. The smaller gear wheel, for example, may preferably have a diameter about one-half the size of the larger gear wheel to provide the proper rotation to dispense a standard sized postage stamp. The inner surface of the stamp roll housing area preferably includes at least one raised band to prevent accumulation of adhesive in the stamp roll housing area. A retaining guard may preferably be formed on the stamp roll housing portion to prevent a stamp roll positioned within the stamp roll housing portion from telescoping. A stamp edge guide may be positioned adjacent a separating edge of the stamp housing to retain the stamps as they advance along an upper surface of the stamp housing. The top shell 11 may include a window to allow visual inspection of stamps within the apparatus. The gear assemblies, the stamp housing, and the top and bottom shells are preferably made of plastic.

The present invention, together with its attendant objectives and advantages, will be further understood with reference to the detailed description and the accompanying drawings.

BRIEF DESCRIPTION OF THE DRAWINGS

FIG. 4 is a sectional bottom view of the stamp affixer;

FIG. 5 is an exploded perspective view of large gear assembly;

FIG. 6 is a perspective view of an alternative preferred embodiment of the stamp housing;

FIG. 17 is a perspective view of the open side of the stamp housing;

FIG. 18 is a perspective view of the reverse side of the stamp housing shown in FIG. 17;

FIG. 19 is a perspective view of the large gear assembly;

FIG. 20 is a perspective view of the drive roller; and

FIG. 21 is a perspective view of the small gear assembly.

DETAILED DESCRIPTION OF THE PRESENTLY PREFERRED EMBODIMENTS

Figure 1:
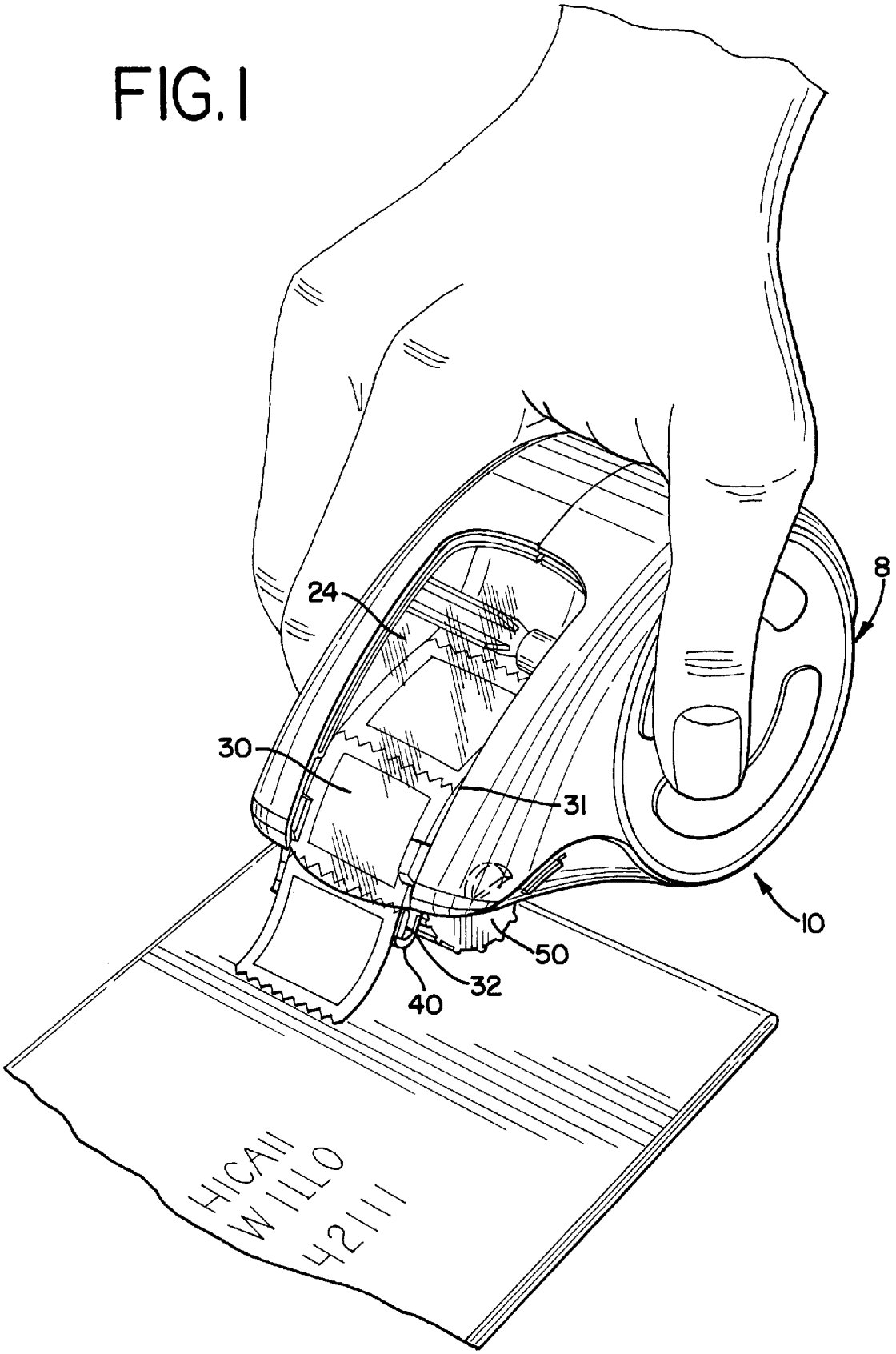
FIG. 1 is a perspective of a preferred embodiment of a stamp affixer in the operating position.
Figure 2:
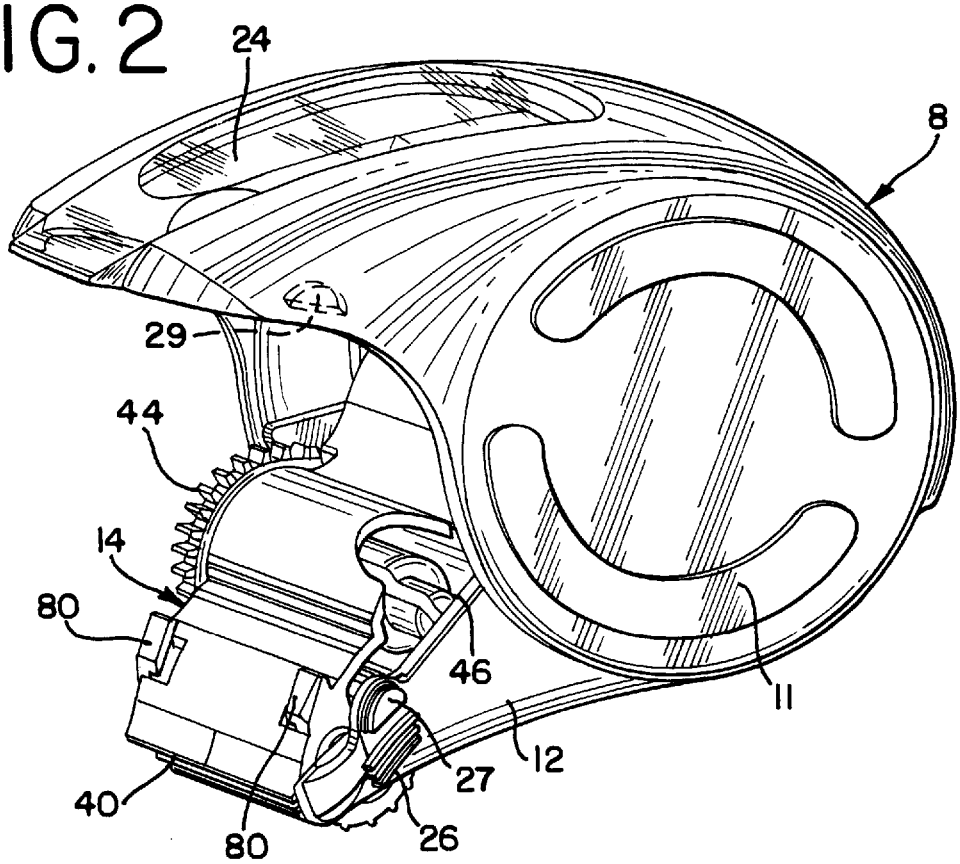
FIG. 2 is a perspective view of an embodiment of stamp affixer with the top shell rotated to an open position.
Figure 3:
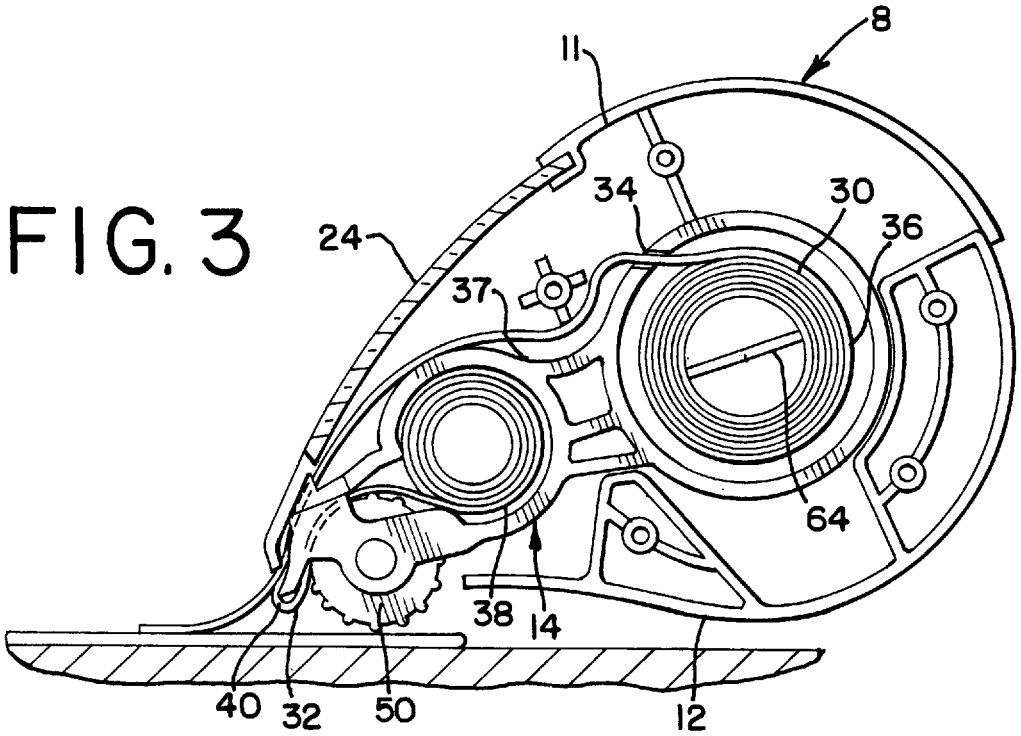
FIG. 3 is a sectional view of an embodiment stamp affixer in the operating position.
Figure 7:
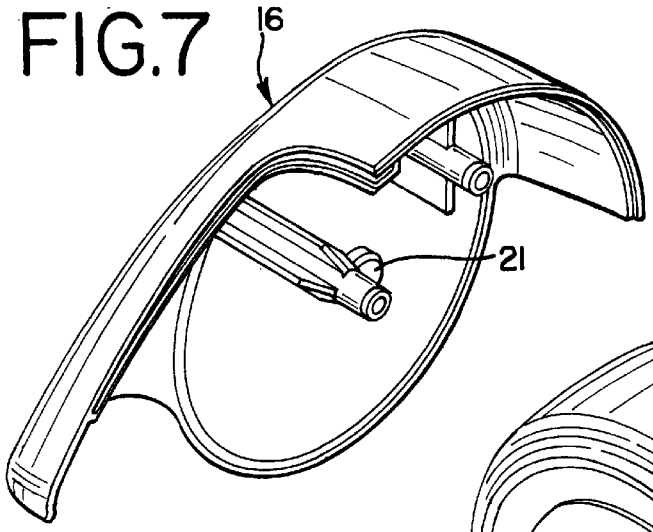
FIG. 7 is a perspective view of the inner side of the top right shell.
Figure 8:
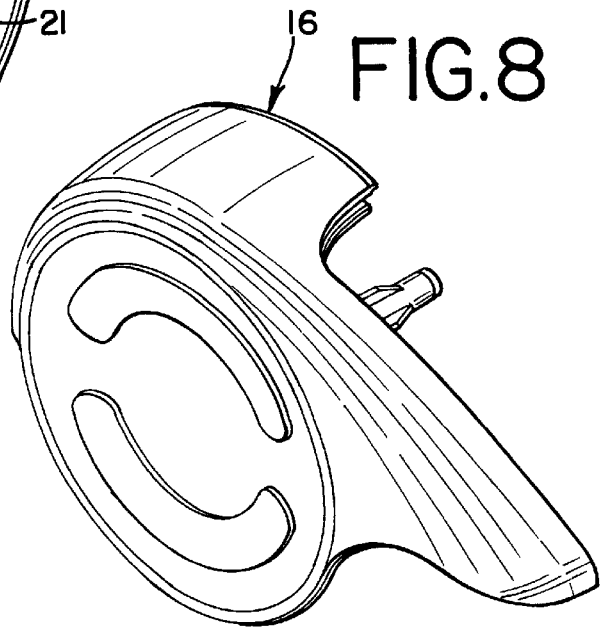
FIG. 8 is a perspective view of the outer side of the top right shell.
Figure 9:
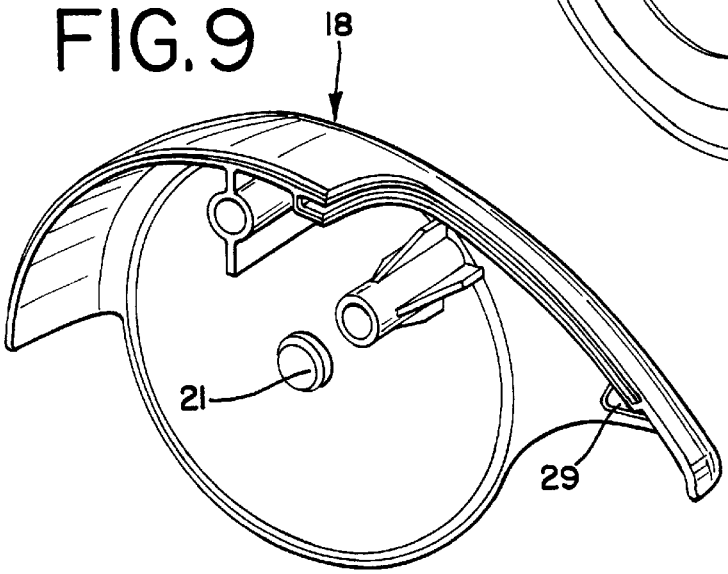
FIG. 9 is a perspective view of the inner side of the top left shell.
Figure 10:
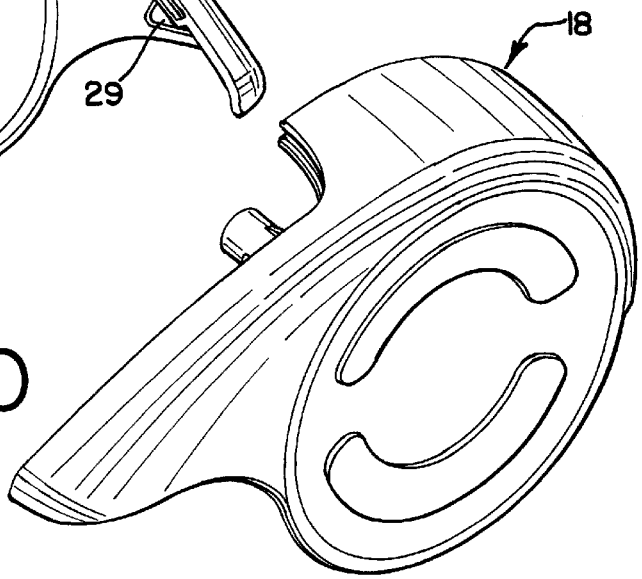
FIG. 10 is a perspective view of the outer side of the top left shell.
Figure 11:
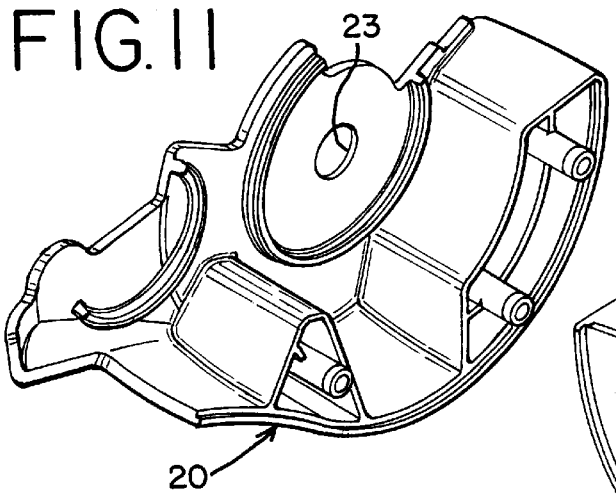
FIG. 11 is a perspective view of an inner side of the bottom right shell.
Figure 12:
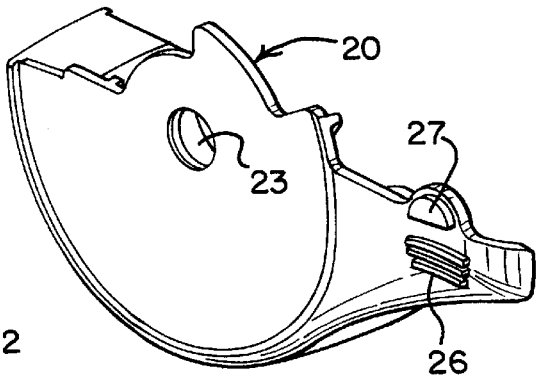
FIG. 12 is an perspective view of the outer side of the bottom right shell.
Figure 13:
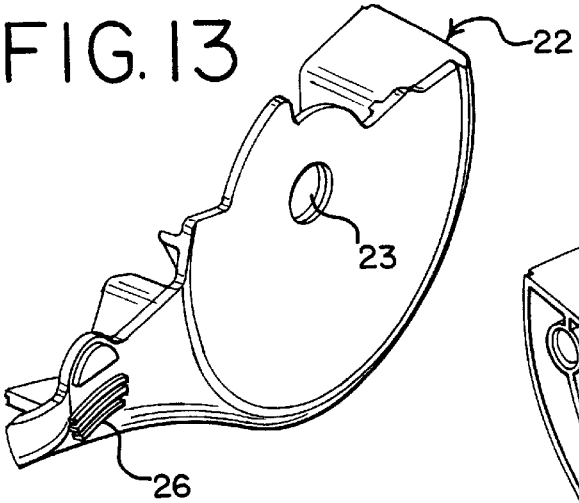
FIG. 13 is a perspective view of the outer side of the bottom left shell.
Figure 14:
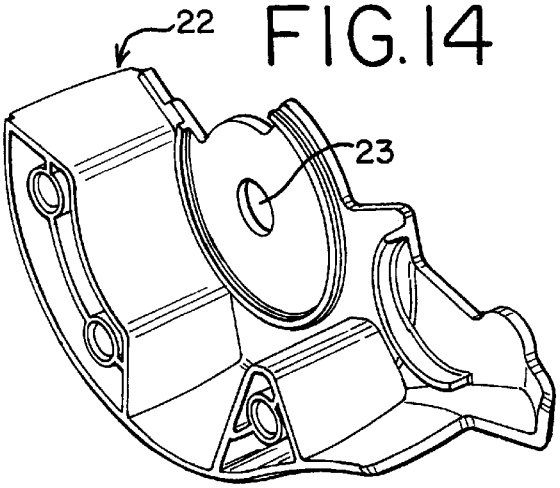
FIG. 14 is a perspective view of the inner side of the bottom left shell.

Referring to FIGS. 1–3, the stamp affixer 10 includes an outer shell 8 and a stamp housing 14. The outer shell preferably includes a top shell 11 and bottom shell 12. Preferably, the stamp housing 14, top shell 11, and bottom shell 12 are made of molded plastic. As shown in FIGS. 7–10, the top shell 11 may preferably include two separate sections, a top right shell 16 and a top left shell 18, which snap fit together. As shown in FIGS. 11–14, the bottom shell 12 may preferably include a bottom right shell 20 and a bottom left shell 22, which snap fit together. The top shell 11 preferably includes cylindrical portions 21 that are received in openings 23 formed in the bottom shell 12. The opening 23 establish an axis point to allow the top shell 11 to rotate to an open position. When the top shell 11 is rotated to an open position, as shown in FIG. 2, the stamp housing 14 may be removed for loading stamp rolls and unloading backing paper. As shown in FIG. 2, the bottom shell 12 preferably includes at least one raised portion 27, which is received in a recessed area 29 formed on an inner surface of the top shell 11 to lock the top and bottom shells together in the closed and operating position. As shown in FIGS. 2 and 11–14, the bottom right shell 20 and bottom left shell 22 may preferably be provided with ribs 26 which may be pressed inward by a user to release the raised portion 27 from the recessed area 29, and allow the top and bottom shells to be rotated to an open position.

Figure 15:
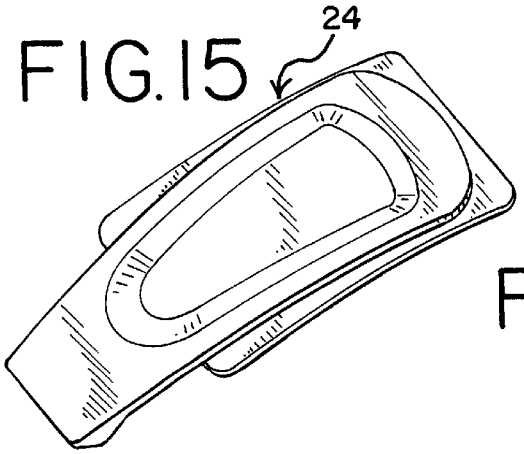
FIG. 15 is a perspective view of the outer side of the window.
Figure 16:
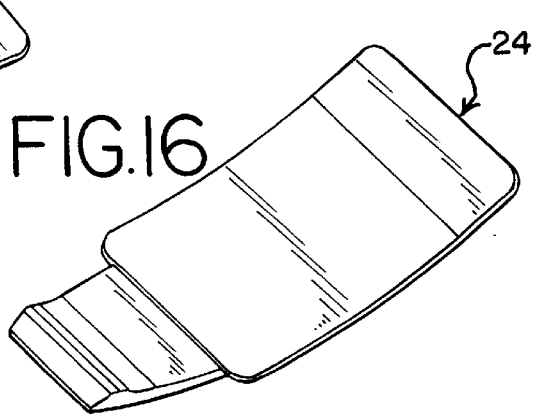
FIG. 16 is a perspective view of the inner side of the window.

As shown in FIGS. 1, 15 and 16, a window 24 may preferably be positioned between the top right shell 16 and top left shell 18 to allow the user to visually inspect the stamps within the stamp affixer 10. The window 24 may be useful in determining, for example, if the stamps need replacing or the denomination of the stamps.

Referring to FIGS. 3–4, 6, 17–18, the stamp housing 14 preferably includes a stamp roll housing portion 36 and a backing paper housing portion 38. In one preferred embodiment, as shown in FIGS. 4, 17–18, the stamp roll housing portion 36 may include a spindle 28 for receiving a roll of adhesive backed stamps. As shown in FIGS. 3 and 6, the stamp housing 14 may alternatively be formed without a spindle 28, but preferably includes a retaining guard 62. As shown in FIG. 6, a back portion of the stamp roll housing 36 may be formed with an opening to allow easy placement of a roll of stamps into the stamp roll housing portion 36. As shown in FIG. 3, the inner wall of the stamp housing portion 36 may preferably include raised band 64 positioned across the diameter of the inner wall to prevent the side of a stamp roll 30 from contacting the inner wall of the stamp roll housing portion 36. The raised band 64 helps to prevent accumulation of adhesive residue which may otherwise accumulate in the stamp roll housing portion 36 and hinder the operation of the stamp affixer.

As shown in FIG. 1, the stamps 30 are separated by perforations 31, and the adhesive side of the stamps are attached to backing paper 32. The stamps along with the backing paper are threaded through a slit 34 formed in the stamp roll housing portion 36 of the stamp housing 14. The top outer surface 37 of the stamp housing 14 has a curved contour, which may help break the perforations 31 to allow a single stamp to be dispensed and affixed to a package or envelope. As shown in FIG. 3, the backing paper 32 is separated from the individual stamps at the separation edge 40 of the stamp housing 14. The front portion of the stamp housing 14 may also preferably include stamp edge guides 80 to help guide the stamps as they move along the upper surface 31 of the stamp housing.

As shown in FIG. 19, a first or large gear assembly 42, which includes gear wheel 44 and shaft 46 may be formed as an integral member. Alternatively, as shown in FIG. 5, the gear wheel 68 and shaft 70 may be formed as separate members. The shaft 70 includes a rectangular shaped shaft end 72, which includes slit 74 for receiving a lead-in portion of the backing paper 32. The shaft 70 also includes extended locking members 76 which fit into opening 78 of the gear wheel 68 and secure the shaft 70 to the gear wheel 68. As shown in FIGS. 6 and 18, the shaft 46 or 70 fits through the opening 48 of the backing paper housing portion 38 of the stamp housing 14. A lead-in portion of backing paper is positioned within the slit 45, 74 formed through the shaft 46, 70.

As shown in FIGS. 3 and 20, a drive roller 50 is positioned beneath the front portion of the stamp housing 14. As shown in FIG. 21, a second small gear assembly 54 is shown, and includes shaft 58 and gear wheel 56. The drive roller 50 has an opening 52 which receives the shaft 58 of small gear assembly 54. The drive roller 50 is preferably made of rubber or other suitable material. As shown in FIG. 4, the gear wheel 56 of the small gear assembly 54 engages with the gear wheel 44 of the large gear assembly 42.

To operate the stamp affixer 10, the user would insert, for example, a standard sized roll of postage stamps 30 into the stamp roll housing portion 36 of the stamp housing 14. The user may then peel off several stamps to create a lead-in portion of backing paper which is inserted into the slit 74, 45 formed in the shaft 46, 70 of the large gear assembly. The stamp housing may then be positioned within the outer shell while the top and bottom shells are in the open position. The top and bottom shells 11, 12 may then be rotated to the closed position. The raised portion 27 of the bottom shell would snap fit into the recessed area 29 of the top shell 11 to lock the shell portions together and prevent movement of the stamp housing 14 within the outer shell 8. In the closed position, the user would pull the drive roller 50 against the package, envelope, or other desired surface. This action would rotate the drive roller 50, which is fixedly connected to the small gear assembly 54 in a first, for example, clockwise direction. The clockwise rotation of the small gear wheel 56 which is engaged with the large gear wheel 44 or 68, would rotate the large gear assembly in a second or counter-clockwise direction. The rotation of the shaft 46, 70 of the large gear assembly would pull the backing paper 32 over the separating edge 40 of the stamp housing and wrap it around the shaft portion of the large gear assembly. The large gear wheel 44 or 68 is preferably sized in relation to the small gear wheel and drive roller to provide a comfortable rolling distance to dispense a single stamp. For the embodiment shown, the large gear wheel may, for example, preferably have a diameter of 1.1 inches, which is approximately twice as large as the diameter of the drive roller 50 and the small gear wheel 56. These diameter sizes have been tested to comfortably dispense a standard 1 inch postage stamp. As the stamp affixer 10 is moved along the surface of the desired surface, the adhesive portion of the stamp is dispensed against the surface. The user may then use his free hand to apply pressure to the stamp to assure the stamp is securely affixed to the surface. When all stamps have been dispensed, the user merely presses on the ribbed regions 26 on the bottom shell 12 to release the raised portions 27 from the recessed areas 29. The top and bottom shells may then be rotated to an open position to allow the stamp housing 14 to be removed and refilled with a new roll of stamps.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

I claim:

1. A stamp affixing apparatus comprising:

a stamp housing, the stamp housing partially enclosed within an outer shell, the outer shell comprises a top shell rotatable connected to a bottom shell; and a first gear assembly rotatably attached to the stamp housing, the first gear assembly engaged with a second gear assembly, the second gear assembly fixedly attached to a drive roller, the second gear assembly rotatably attached to the stamp housing.

2. The apparatus of claim 1 further comprising a window positioned between two top shell portions to allow a user to visually inspect the stamps.

3. The apparatus of claim 1 further comprising a raised portion formed on an outer surface of the bottom shell portion to engage with a recessed area formed on an inner surface of the top shell portion.

4. The apparatus claim 1 wherein the outer surface of the stamp housing is curved to aid in the breaking of the perforations.

5. The apparatus of claim 1 wherein the stamp housing includes a separating edge in which backing paper is pulled over and separated from adhesive backed stamps.

6. The apparatus of claim 1 wherein the stamp housing is made of molded plastic.

7. A method of affixing adhesive backed stamps comprising:

providing a stamp housing including a first gear assembly engaged with a second gear assembly, the first gear assembly rotatably attached to the stamp housing, the second gear assembly fixedly attached to a drive roller, the second gear assembly rotatably attached to the stamp housing, the stamp housing partially enclosed within an outer shell, the outer shell including a top shell rotatably connected to a bottom shell;

providing a roll of adhesive backed stamps on backing paper, a lead-in portion of the backing paper attached to the first gear assembly, the roll being rotatably positioned in the stamp housing; and pulling the drive roller against a surface to rotate the drive roller and the second gear assembly in a first direction, and simultaneously rotating the first gear assembly in a second direction to wrap the backing paper around the first gear assembly and dispense a stamp against the surface.

8. A stamp affixing apparatus comprising:

a top shell;

a bottom shell rotatably attached to the top shell;

a stamp housing positioned partially within an enclosure formed between the top shell and bottom shell, the stamp housing including a stamp roll housing portion and a backing paper housing portion;

a first gear assembly rotatably attached to the backing paper housing portion;

a second gear assembly engaged with the first gear assembly, the second gear assembly rotatably attached to the stamp housing; and a drive roller fixedly attached to the second gear assembly.

9. The apparatus of claim 8 wherein the outer surface of the stamp housing has a curved contour.

10. The apparatus of claim 8 wherein the first gear assembly comprises a gear wheel attached to a shaft, the shaft includes a slit formed therein for receiving a lead-in portion of backing paper.

11. The apparatus of claim 8 further comprising a spindle formed in the stamp roll housing for receiving a stamp roll.

12. The apparatus of claim 8 wherein the second gear assembly includes a gear wheel attached to a shaft, the gear wheel of the second gear assembly being smaller than the gear wheel of the first gear assembly.

13. The apparatus of claim 12 wherein the smaller gear wheel is about one-half the size of the larger gear wheel.

14. The apparatus of claim 8 wherein the inner surface of the stamp roll housing area includes at least one raised band to prevent accumulation of adhesive in the stamp roll housing area.

15. The apparatus of claim 8 further comprising at least one retaining guard formed on the stamp roll housing portion to prevent a stamp roll positioned within the stamp roll housing portion from telescoping.

16. The apparatus of claim 8 further comprising an stamp edge guide positioned adjacent a separating edge of the stamp housing to guide in the stamps as they advance along an upper surface of the stamp housing.

17. The apparatus of claim 8 wherein the top shell includes a window to allow visual inspection of stamps.

18. The apparatus of claim 8 wherein the gear assemblies, the stamp housing, and the top and bottom shells are made of plastic.

* * * * *